US006296438B1

(12) United States Patent
Stähle

(10) Patent No.: US 6,296,438 B1
(45) Date of Patent: Oct. 2, 2001

(54) DEVICE FOR THE REGULATION OF THE PUMPING CAPACITY OF VERTICAL-AXIS CENTRIFUGAL PUMPS

(75) Inventor: Frank Stähle, Neunkirch (CH)

(73) Assignee: Frideco AG (CH)

( * ) Notice: Subject to any disclaimer, the term of this patent is extended or adjusted under 35 U.S.C. 154(b) by 0 days.

(21) Appl. No.: 09/482,739

(22) Filed: Jan. 13, 2000

(30) Foreign Application Priority Data

Jan. 13, 1999 (CH) ..... 0052/99

(51) Int. Cl.[7] ..... F04D 1/00
(52) U.S. Cl. ..... 415/3.1
(58) Field of Search ..... 415/2.1, 3.1, 182.1; 290/42, 43, 53, 54

(56) References Cited

U.S. PATENT DOCUMENTS 4,141,670 * 2/1979 Russell ..... 415/3.1
5,083,899 * 1/1992 Koch ..... 415/2.1
5,440,175 * 8/1995 Mayo, Jr. et al. ..... 415/3.1

FOREIGN PATENT DOCUMENTS 533242 3/1973 (CH) .
580229 9/1976 (CH) .

* cited by examiner

*Primary Examiner*—John Kwon
(74) *Attorney, Agent, or Firm*—Webb Ziesenheim Logsdon Orkin & Hanson, P.C.

(57) ABSTRACT

The present invention relates to a device for regulating the pumping capacity of constant-speed vertical-axis centrifuge pumps having an admission cross section with a weir, a suction orifice of a pump submerged in a reservoir that is open on top, an impeller axis, and a fluid inlet opening that emerges tangentially in the direction of the impeller rotation. The fluid inlet opening forms an opening in the weir and is located below the upper edge of the weir. The lower portion of a cylindrical reservoir wall is provided so that a rotational flow can be created in the reservoir. In the portion of the admission cross section that lies above the weir, and on the side of the fluid inlet opening that lies below the weir, there is a deflector plate, so that the fluid is deflected around the pump axis in the direction of rotation opposite to the above-mentioned rotational flow in the reservoir.

9 Claims, 1 Drawing Sheet

DEVICE FOR THE REGULATION OF THE PUMPING CAPACITY OF VERTICAL-AXIS CENTRIFUGAL PUMPS

BACKGROUND OF THE INVENTION

1. Field of the Invention

This invention relates to constant-speed vertical-axis centrifugal pumps and, more particularly, a device for regulating the pumping capacity of said pumps. The present application claims priority under 35 U.S.C. §119 to Swiss Application No. 0052/99, which is herein incorporated by reference.

2. Brief Description of the Prior Art

In pumping systems where the volume of water to be transported fluctuates, such as with municipal waste water or rain water, there is a simple device that adapts a pumping capacity to a current volume of fluid to be pumped by means of an appropriate change in the shape of a pumping pit, without any variation in the speed of the pump.

One such prior art device is described in CH 533,242 and CH 580,229. The device consists of an open cylinder which is located in the pumping pit. Above the bottom of the cylinder there is a tangential inlet that corresponds to the direction of rotation of a pump extending into the cylinder. A suction pipe is connected to the suction side of the pump.

If the volume of water in the pit is great enough that the water level rises above the edge of the cylinder, the water flows over the edge of the cylinder, into the cylinder, and directly to the pump suction tube, without any significant difference between the levels inside and outside the cylinder. The pump thereby achieves its full pumping capacity. If the volume of water inside the pit decreases, less and less water can flow over the edge of the cylinder, and the water level inside the cylinder becomes lower than the level outside the cylinder. Consequently, more and more water flows through the tangential inlet opening into the cylinder and generates a rotational movement of the water inside the cylinder that becomes more intense as the difference between the two levels increases. This swirl, which is generated in the direction of rotation of the pump, causes a corresponding reduction of the pumping capacity, such that it always corresponds to the reduced volume of water to be pumped. In this manner, the pumping capacity of the pump can be regulated in a range from approximately 50% to 100%.

At full-load operation, however, this device has one disadvantage. As a result of the configuration of the device described above, there is a rotational motion of the water in the interior of the cylinder even when the pump is operating at full pumping capacity. This minimal residual swirl in the direction of rotation of the pump prevents the pump from achieving its maximum pumping capacity, and limits the maximum pumping capacity to values less than 100%.

Therefore, the object of the invention is to improve the maximum achievable pumping capacity of a pump in full-load operation.

SUMMARY OF THE INVENTION

The present invention generally includes a reservoir having a weir. The weir forms a fluid admission cross-section positioned adjacent a first end of the weir, while a fluid inlet is positioned adjacent a second end of the weir, tangential to the reservoir. A deflector plate is positioned above the fluid inlet opening to the cylinder, wherein the inlet opening lies below a first end of the weir. Therefore, when the pump is working at low capacity, water flows unhindered beneath the deflector plate into the cylinder and passes through the fluid inlet opening which creates a rotational flow in the reservoir. However, if the level of the water increases, the water also flows over the top of the weir and the deflector plate is slowly submerged, deflecting an increasing amount of water as the volume of water flowing through the admission cross section increases. Water flowing through the fluid admission cross section is deflected by the deflector plate in a direction of rotation opposite to the rotational flow in the reservoir. At the full-load level, practically the entire amount of fluid entering the admission cross section above the weir is forced into the opposite direction of rotation. This opposite rotational flow counteracts the swirl generated by the fluid inlet opening underneath the weir and neutralizes the latter flow.

The invention is explained in greater detail below with reference to one exemplary embodiment that is illustrated in the accompanying drawings.

DETAILED DESCRIPTION OF THE PREFERRED EMBODIMENT

Figure 1:
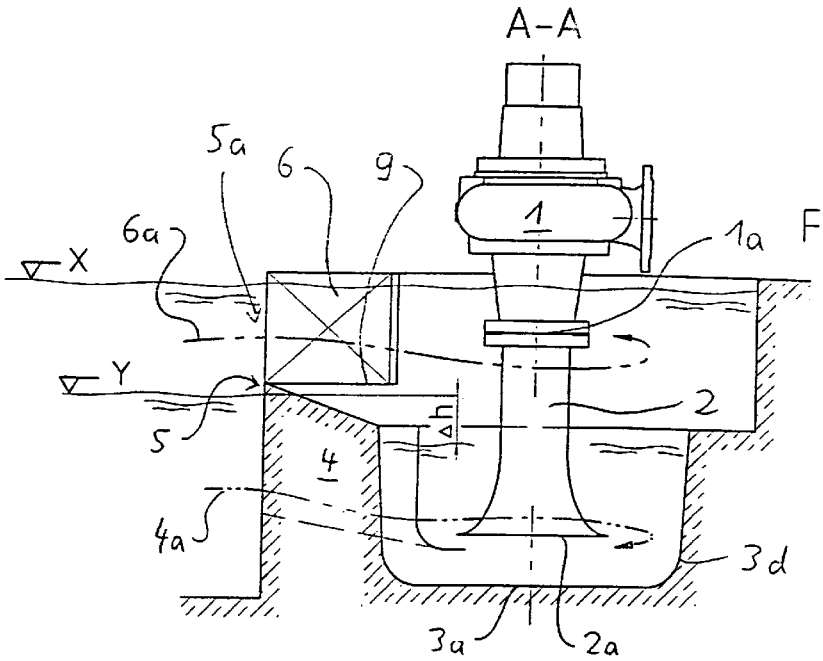
FIG. 1 is a side view of a vertical-axis centrifugal pump with an associated volume regulation device as used in one embodiment of the invention.
Figure 2:
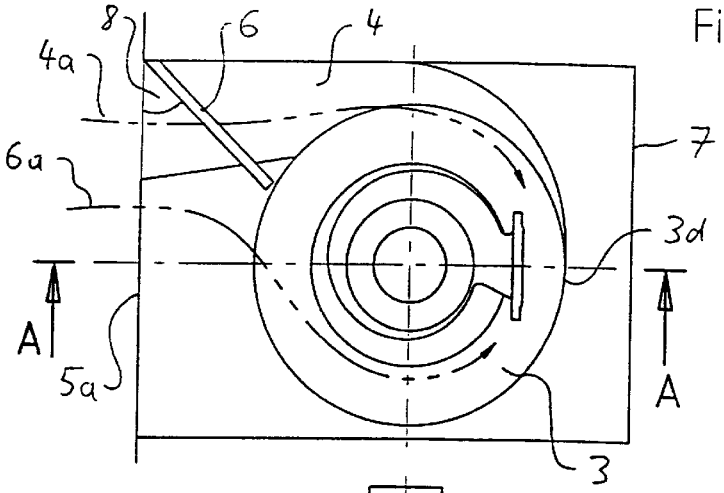
FIG. 2 is an overhead view of the device illustrated in FIG. 1.
Figure 3:
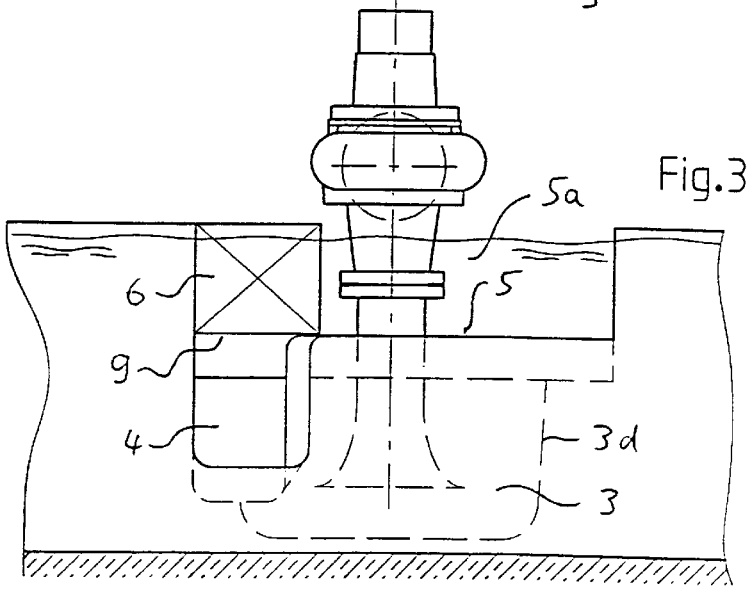
FIG. 3 is a front view of an inlet cross section of the device illustrated in FIG. 1.

One embodiment of the present invention is illustrated in FIGS. 1 to 3. The centrifugal pump 1 draws vertically from the bottom. Attached to suction branch 1*a* is a suction tube 2. The exposed mouth part 2*a* of the suction tube 2 is widened in the shape of a bell and preferably lies at a distance above the bottom 3*a* of a cylinder 3. The cylinder 3 surrounds the suction tube 2 with some radial clearance.

At the level of a pump mouth of the mouth part 2*a*, there is an emergent inlet opening 4 in the wall of the cylinder 3. The inlet opening is tangential to the reservoir, corresponding to the direction of rotation of the centrifugal pump 1. A fluid inlet opening 4 is positioned adjacent a second end of the weir 5 and forms an opening in the weir 5.

At a low feed volume, the surface of the liquid may be at the level S, for example. The liquid flows exclusively through the inlet opening 4 into the cylinder 3, driven by the difference Δh between the level Y and the level of the surface of the liquid inside the cylinder 3. A strong rotational movement is thereby imparted to the fluid inside the cylinder in the direction of rotation 4*a* of the pump. The relative velocity of an impeller in the pump with reference to the incoming fluid is thereby reduced, and the pumping capacity of the pump is adapted to the quantity of fed fluid.

If the volume of water fed to the pump increases, the level of fluid also increases and rises above the first end of the weir 5. From this point on, the inflow occurs over the entire width of an admission cross section 5*a*, the level difference Δh therefore decreases, and the inflow is divided into one portion that follows the tangential inlet openings 4 and another portion that flows essentially in a straight line over the weir 5 into the cylinder 3. The magnitude of the rotational motion of the inflowing fluid in the direction of rotation of the pump is reduced.

If the volume of water fed to the pump increases further, the deflector plate 6 is submerged in the incoming flow. As the effective depth increases, it imparts to the fluid flowing in over the weir 5 a flow direction 6*a* toward the side of the pump that is opposite the tangential inlet opening 4. This is because the deflector plate 6 lies in the part of the inlet cross section 5*a* positioned adjacent the first end of the weir 5 and on the side of the fluid inlet opening 4 positioned adjacent the second end of the weir 5, so that the fluid that flows over the weir 5 to the pump is deflected and is routed around the pump axis 2 in the direction of rotation 6*a* opposite to the above-mentioned rotational flow 4*a* in the reservoir 3.

The magnitude of the deflection is a function of, among other things, the size of the deflector plate 6. The effective size results from the size of the angle 8 at which the deflector plate 6 is positioned in relation to the inflow cross section 5*a*. A lower edge 9 of the deflector plate 6 can also follow the descending profile of the pumping pit 7. The effective width of the plate 6 with reference to the width of the inlet cross section is advantageously greater than the width of the inlet opening 4. The height of the plate equals the height of the pumping pit 7.

In the overhead view of the pump shown in FIG. 2, the deflector plate 6 is at an angle 8 of 45 degrees with respect to the plane of the weir 5 and the fluid inlet opening 4. In other embodiments, this angle 8 can be between 20 and 70 degrees, and is preferably between 30 and 60 degrees.

As FIGS. 2–3 illustrate, the angle 8 is defined so that the pump axis 2, when viewed from the direction of fluid flowing through the admission cross section, lies behind the plane of an imaginary extension of the deflector plate 6. Thus, a sufficient deflection of the incoming fluid around the pump head 1 is generated.

The deflector plate 6 is realized in the form of a rectangle; however, it can also follow, with its lower edge 9, the descending surface of the pumping pit that lies behind the weir. Alternatively, it can also be realized in the form of a trapezoid or a curved line.

The influx through the entire admission cross section 5*a* adjacent the first end of the weir 5 is forced into a direction 6*a* that generates a rotation of the fluid around the pump axis 2, which is oriented in the opposite direction to the rotation 4*a* of the entering fluid generated by the inlet opening 4. Thus the residual swirl caused by the inlet opening 4 and remaining in the cylinder 3 at full pumping capacity is neutralized, and the pump achieves the maximum capacity that corresponds to the characteristics of the pump.

The above-mentioned rotational flow 4*a* that originates in the reservoir 3 always has the direction of rotation of the impeller rotation, and the rotational flow of the liquid 6*a* deflected by the deflector plate 6 is deflected around the pump axis 2 in the direction opposite to the rotation of the impeller.

With a suitable configuration of the size and the flow angle of the deflector plate 6, it is possible to ensure that the intensity of the rotational current 6*a* generated by this plate 6 is greater than the moment of the rotation generated by the fluid inlet opening 4. The fluid in the cylinder 3 executes a rotation opposite to the direction of rotation of the pump impeller which corresponds to the flow 4*a*, so that the fluid is now actively transported to the rotating pump elements of the pump. It is thereby possible to increase the maximum pump capacity.

What is claimed is:

1. A device for regulating a pumping capacity of a constant-speed vertical axis centrifugal pump comprising:

a reservoir having a weir, said weir forming a fluid admission cross section positioned adjacent a first end of said weir and a fluid inlet positioned adjacent a second end of said weir, said fluid inlet positioned tangentially to said reservoir in view of the direction of the pump impeller rotation and a deflector plate positioned in said fluid admission cross section within a section above the weir adjacent to said fluid inlet, wherein said fluid inlet produces a rotational flow around the pump impeller axis in said reservoir and fluid flowing through said fluid admission cross section is deflected by said deflector plate in a direction of rotation opposite to said rotational flow in said reservoir.

2. The device for regulating a pumping capacity of a constant-speed vertical axis centrifugal pump as claimed in claim 1 wherein said rotational flow in said reservoir has a direction of rotation corresponding to a pump impeller rotation and said deflector plate deflects fluid around the pump impeller axis in a direction opposite to said pump impeller rotation.

3. The device for regulating a pumping capacity of a constant-speed vertical axis centrifugal pump as claimed in claim 1 wherein said deflector plate is configured so that the intensity of a fluid rotation created by said deflector plate is equal to the intensity of said rotational flow created by said fluid inlet to neutralise it.

4. The device for regulating a pumping capacity of a constant-speed vertical axis centrifugal pump as claimed in claim 1 wherein said deflector plate is configured so that a fluid rotation intensity created by said deflector plate is greater than said rotational flow intensity created by said fluid inlet so fluid in said reservoir rotates opposite to a rotation of a pump impeller positioned in said reservoir.

5. The device for regulating a pumping capacity of a constant-speed vertical axis centrifugal pump as claimed in claim 1 wherein said deflector plate is wider than said fluid inlet in a frontal view so said deflector plate extends beyond said first end of said weir in an overhead view.

6. The device for regulating a pumping capacity of a constant-speed vertical axis centrifugal pump as claimed in claim 1 wherein said deflector plate forms an angle of between 20 and 70 degrees with respect to a plane passing through said weir and said fluid inlet, perpendicular to a base of said reservoir.

7. The device for regulating a pumping capacity of a constant-speed vertical axis centrifugal pump claimed in claim 1 wherein said deflector plate forms a rectangle.

8. The device for regulating a pumping capacity of a constant-speed vertical axis centrifugal pump as claimed in claim 1 wherein said deflector plate has a lower edge following a descending surface of said reservoir, said lower edge forming a curved line.

9. The device for regulating a pumping capacity of a constant-speed vertical axis centrifugal pump as claimed in claim 1 wherein said deflector plate has a lower edge following a descending surface of said reservoir, said lower edge forming a trapezoid.

* * * * *